US012668977B2

(12) United States Patent
Bayram

(10) Patent No.: US 12,668,977 B2
(45) Date of Patent: Jun. 30, 2026

(54) VENTILATED FACADE CLADDING SYSTEM

(71) Applicant: BKÜP MIMARLIK ANONIM ŞIRKETI, Istanbul (TR)

(72) Inventor: Serkan Sabri Bayram, Istanbul (TR)

( * ) Notice: Subject to any disclaimer, the term of this patent is extended or adjusted under 35 U.S.C. 154(b) by 122 days.

(21) Appl. No.: 18/555,064

(22) PCT Filed: Jul. 26, 2022

(86) PCT No.: PCT/TR2022/050791

§ 371 (c)(1),
(2) Date: Oct. 12, 2023

(87) PCT Pub. No.: WO2024/025485

PCT Pub. Date: Feb. 1, 2024

(65) Prior Publication Data

US 2025/0092685 A1 Mar. 20, 2025

(51) Int. Cl.
*E04F 13/08* (2006.01)

(52) U.S. Cl.
CPC ..... *E04F 13/081* (2013.01)

(58) Field of Classification Search
CPC ... E04F 13/0805; E04F 13/081; E04F 13/083; E04F 19/064; E04B 1/7637
USPC ..... 52/302.1
See application file for complete search history.

(56) References Cited

U.S. PATENT DOCUMENTS 1,991,550 A * 2/1935 Duffy ..... E04F 13/0805 362/147
3,561,182 A * 2/1971 Madl, Jr. ..... E04F 13/0826 52/235
3,621,635 A * 11/1971 De Lange ..... E04F 13/144 52/459
4,070,835 A * 1/1978 Reverend ..... E04F 13/0808 52/235
4,483,122 A * 11/1984 Crandell ..... E04F 13/0808 52/235
4,840,004 A * 6/1989 Ting ..... E04F 13/0803 52/235
4,866,896 A * 9/1989 Shreiner ..... E04F 13/0736 52/235

(Continued)

FOREIGN PATENT DOCUMENTS

EP 1172500 A1 1/2002
KR 20210136300 A 11/2021

OTHER PUBLICATIONS

International Search Report and Written Opinion of the International Searching Authority for corresponding PCT/TR2022/050791 dated Apr. 14, 2023.

*Primary Examiner* — James M Ference
(74) *Attorney, Agent, or Firm* — EGBERT, MCDANIEL & SWARTZ, PLLC

(57) ABSTRACT

A ventilated facade cladding system has a plurality of horizontal tracks, a plurality of hanging clips, a plurality of brackets, a plurality of bracket clips and a plurality of mullion profiles. The horizontal tracks are adapted to be mounted sequentially to a wall. The hanging clips are positioned and slidable on the horizontal track. The bracket is positioned between the hanging clips. The bracket clip is attached to the bracket and slidable through a clip gap. The mullion profile is mounted vertically between the brackets and the bracket clips.

10 Claims, 5 Drawing Sheets

(56) References Cited

U.S. PATENT DOCUMENTS 5,301,484 A * 4/1994 Jansson ..... E04F 13/145 52/235
5,598,671 A * 2/1997 Ting ..... E06B 7/14 52/234
6,226,947 B1 * 5/2001 Bado ..... E04F 13/0816 52/479
7,134,247 B2 * 11/2006 Ting ..... E06B 9/52 52/234
8,122,650 B2 * 2/2012 Eickhof ..... E04H 13/006 52/510
8,127,507 B1 * 3/2012 Bilge ..... E04F 13/0814 52/235
8,166,716 B2 * 5/2012 Macdonald ..... E04F 13/0826 52/235
8,555,577 B2 * 10/2013 Maday ..... E04F 13/083 52/510
8,833,017 B1 * 9/2014 Huang ..... E04F 13/144 52/510
9,359,771 B1 * 6/2016 Delforte ..... E04F 13/083
10,253,507 B1 * 4/2019 Bilge ..... E04F 13/0807
10,893,647 B1 * 1/2021 Bilge ..... E04D 13/0445
10,900,239 B1 * 1/2021 Bilge ..... E04F 13/083
2003/0150179 A1 * 8/2003 Moreno ..... E04F 13/0808 52/235
2004/0079038 A1 * 4/2004 Crooker, Jr. ..... E04B 2/96 52/489.1
2009/0241451 A1 * 10/2009 Griffiths ..... E04F 13/0889 52/309.4
2009/0272055 A1 * 11/2009 Griffiths ..... E04F 13/0889 52/309.3
2010/0115863 A1 * 5/2010 Braybrook ..... E04B 2/96 52/235
2012/0151867 A1 * 6/2012 Smith ..... E04D 3/366 52/582.1
2012/0186170 A1 * 7/2012 Macdonald ..... E04F 13/083 52/173.3
2012/0199708 A1 * 8/2012 Convey ..... E04F 13/081 29/428
2012/0304573 A1 * 12/2012 Aboukhalil ..... E04F 19/061 52/506.05
2013/0205698 A1 * 8/2013 Todd ..... E04B 2/88 52/302.1
2016/0145875 A1 * 5/2016 Scully ..... E04F 13/14 52/698
2019/0100913 A1 * 4/2019 Doyon ..... E04B 2/885
2021/0277665 A1 * 9/2021 Bilge ..... E04F 13/081
2022/0112724 A1 * 4/2022 Chang ..... E04F 13/0821
2024/0200340 A1 * 6/2024 Shen ..... E04F 13/0805
2025/0092685 A1 * 3/2025 Bayram ..... E04F 13/081

* cited by examiner

VENTILATED FACADE CLADDING SYSTEM

TECHNICAL FIELD

The present invention is a ventilated facade cladding system that includes sliding installation, horizontal bracket, and corner fitting profile systems.

BACKGROUND

Traditional ventilated facade system is commonly used in facade cladding. In traditional system, the siding material (granite, ceramic, terracotta, composite, etc.) is covered on the brackets screwed to the outer surface of the building and L or T profiles screwed to the brackets. Each bracket must be aligned horizontally and vertically. This is an engineering practice and a time consuming process. In addition, T and L profiles screwed to the brackets must be adjusted individually for each bracket for alignment.

While the brackets are screwed to the facade in wooden construction structures, there must be wooden carriers at the back and the screws must be screwed to the carriers. This situation prolongs the construction process.

The application numbered EP1172500A1 describes a ventilated facade cladding system for building has a support frame formed by a plurality of spaced-apart upright mullions fixed to an exterior of a building by anchor brackets, with a number of horizontal cladding panel support rails mounted in vertically spaced-apart rows on the mullions. Each cladding panel is mounted between an adjacent pair of vertically spaced-apart rails with a bottom of the cladding panel seated on the lowermost rail and a top of the cladding panel secured to the uppermost rail by a pair of retaining dips. A bottom of each stone cladding panel is fully supported along its length by the lowermost rail. However, the application fails to mention any kind of sliding installation mechanism or corner fitting profile.

SUMMARY

The subject of the invention is ST-HHS (Sthetics Horizontal Hanging System) that uses ventilated facade cladding system includes unique sliding installation mechanism, horizontal bracket, hanging clips and corner fitting profile systems. The most important feature of the invention is that it can be applied regardless of the type of facade. For this reason, it is suitable for all kinds of building typologies (wood, reinforced concrete, steel, etc.) and the application method does not differ according to the structure system.

In conventional systems, while the brackets are mounted one by one, in the proposed system, the bracket is a horizontal continuous element and mounted on the facade. This also means usage of less screws. It is a surface-to-surface system and, if necessary, a support bracket is placed between two surfaces according to the static calculation.

The system subject to the invention has eliminated the necessity of finding the carrier studs at the back during assembly in wooden structures.

Profiles, on the other hand, are mounted on the horizontally extending brackets with the hanging logic and vertical alignment is very practical as the profiles slide on the horizontal bracket. It provides significant savings in labour and time.

Advantages of the proposed system over the traditional ventilated facade system are as follows:

- Faster to assemble.
- Plumbing problems in the existing structure are prevented.
- There is not much penetration on the applied facade element.
- Fewer anchors (less screws) and still have higher reliability.
- In particularly Canadian and American structures (usually wooden structures), it is a difficulty to catch vertical carrier profiles during application in the traditional systems, but this problem disappears in our system because it works floor to floor.
- The number of brackets used is less than the traditional system.
- It is possible to automatically align the profiles to each other and to provide a better dilatation.
- Provides flexibility in horizontal movements.
- It is a more efficient system due to its ease and speed of implementation.
- Corner finishes are produced faster and without errors, thanks to the innovative sliding mounting system.
- Tiles are easily adhered to the workbench beforehand and can be easily mounted to the carrier system with screws.
- Since the system is completely aluminum, there is no risk of corrosion.

PART REFERENCES

Figure 1:
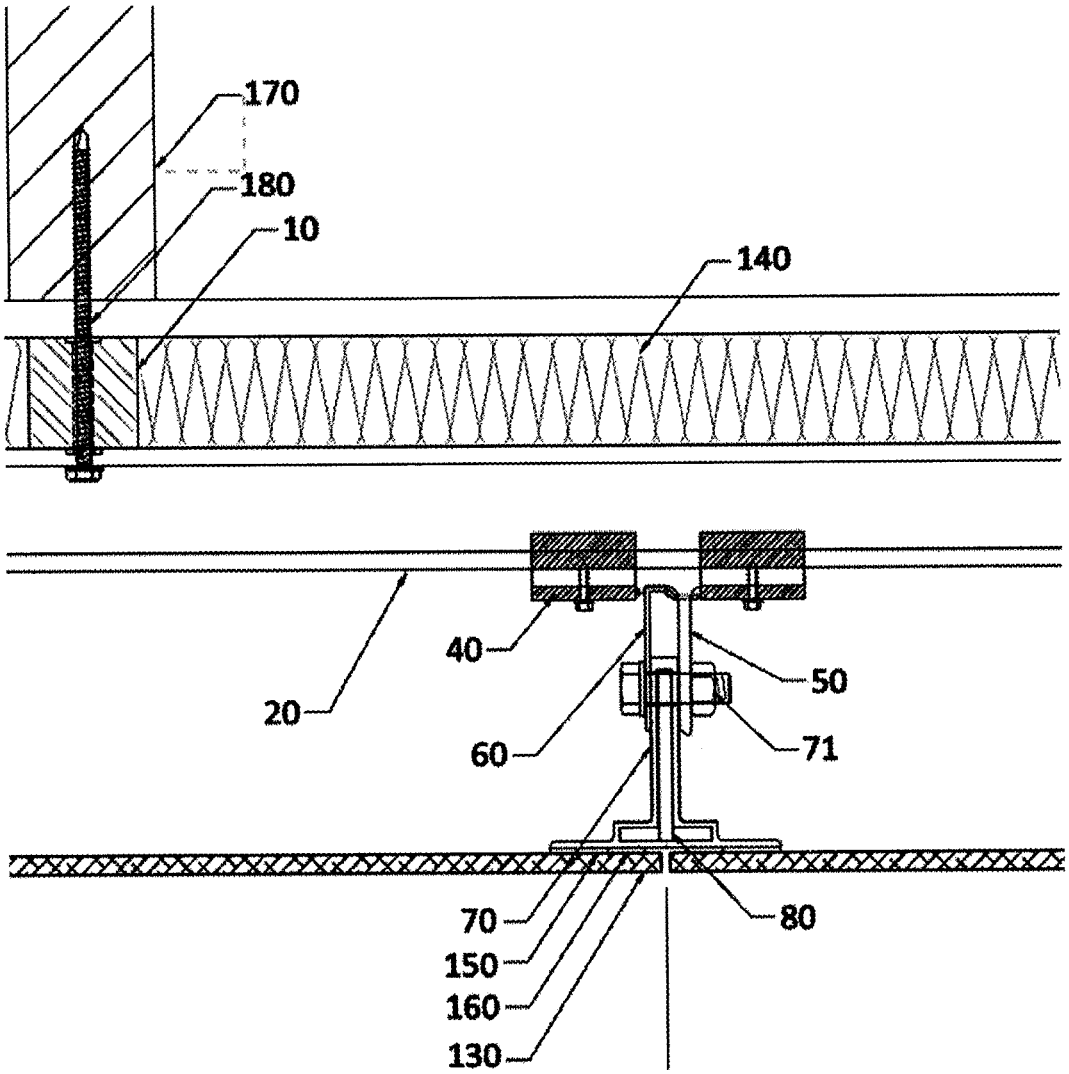
FIG. 1 shows cladding tile joint plan detail of the present invention.

10. Spacer washer
20. Horizontal track
  21. Extension profile
30. Horizontal connection profile
40. Hanging clip
50. Bracket
60. Bracket clip
  61. Clip gap
70. Mullion profile
  71. Bolt
80. Expansion profile
90. Corner profile
  91. Cavity
100. Corner fixing gasket
110. Corner support profile
120. Corner support bracket
130. Tile
140. Insulation layer
150. Bonding material
160. Tape
170. Stud
180. Screw
190. Sheathing board

DETAILED DESCRIPTION

Figure 4:
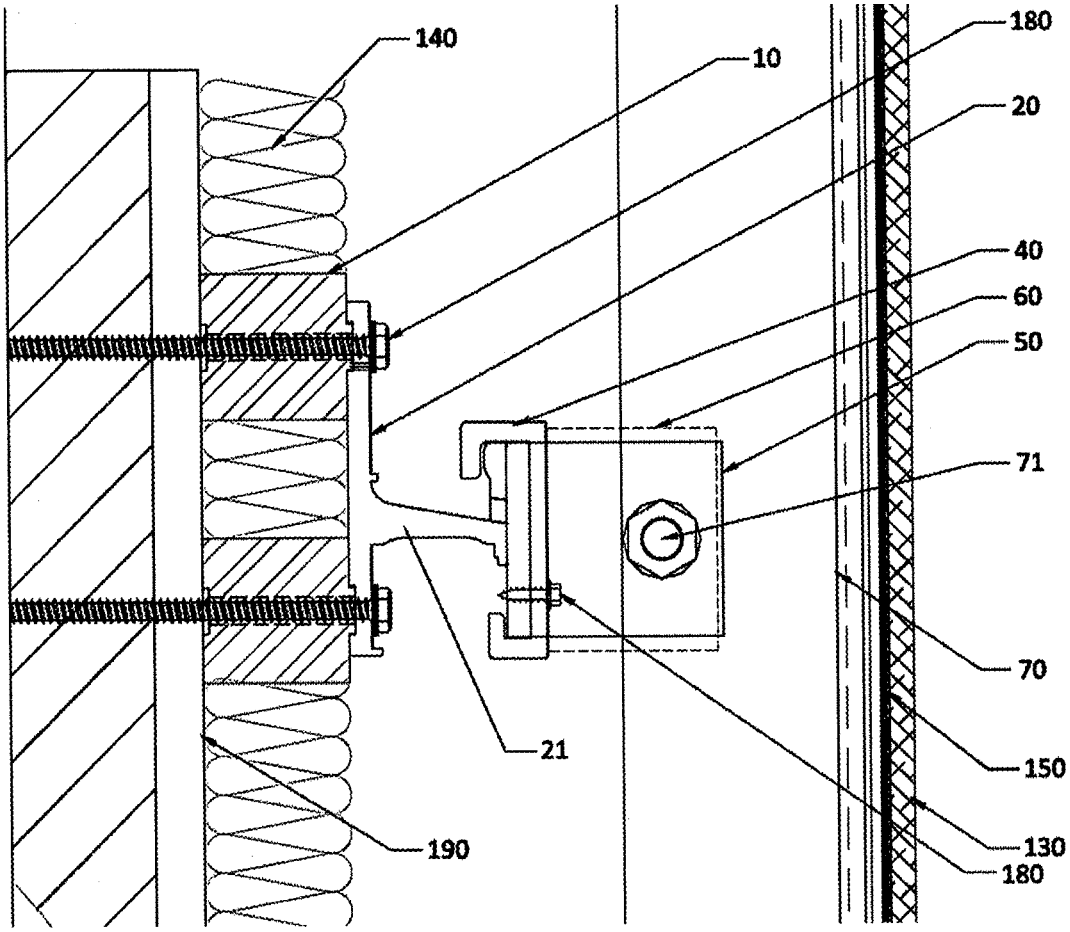
FIG. 4 shows section detailed view of the present invention.
Figure 5:
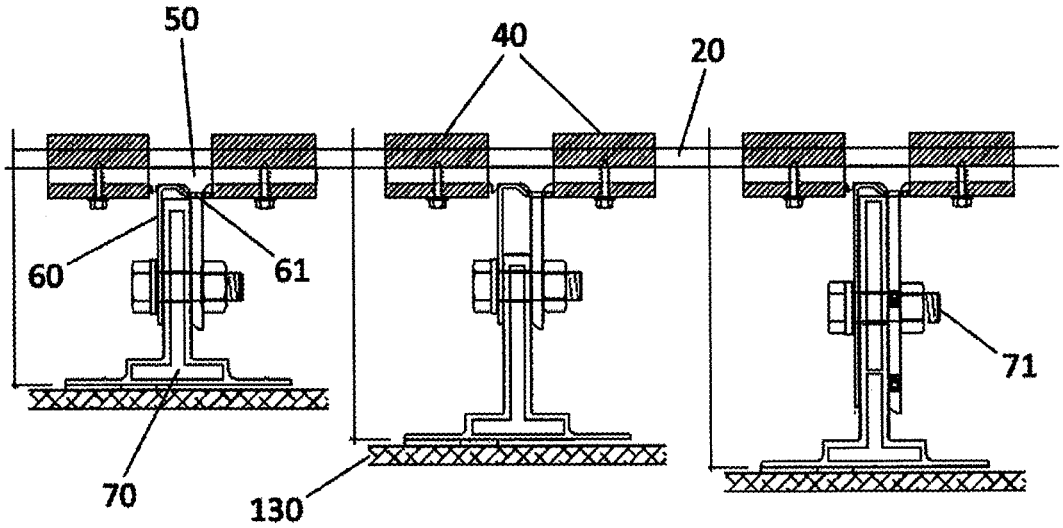
FIG. 5 shows connection of mullions with different depths between brackets.

The present invention describes a ventilated facade cladding system comprising horizontal tracks (20) with a T- or L-shaped extension profile (21), mounted to a wall gradually as shown in FIG. 4. Hanging clips (40) placed on the horizontal tracks (20) and can be slid on them. Brackets (50) having T- or L-shape form, placed between the hanging clips (40), fixed in the space between the extension profile (21) and the hanging clip (40). Bracket clips (60) having L-shape form, attached to the bracket (50) sliding through a clip gap (61). Mullion profiles (70) having T-shape form, wherein vertical part positioned in desired depth as shown in FIG. 5 and fixed between the bracket (50) and the bracket clip (60), wherein tile (130) is bonded with horizontal part.

Horizontal tracks (20) at floor slab level will carry dead loads. Hanging clips (40) with hook shaped bottom end should be placed on the main horizontal carrier at the floor slab level, while common hanging clips (40) should be placed to the mid-span to allow the vertical thermal expansion. While the hanging clips (20) are placed on the horizontal tracks (20), two clips (40) per bracket (50) should be placed, one on the right side and one on the left side.

Before T-shaped mullion profiles (70) are completely fixed, the distance from the building should be adjusted vertically, then they should be fixed. After the vertical part fixed between the bracket (50) and the bracket clip (60) via a bolt (71) preferably, tiles (130) are bonded with horizontal part by using a bonding material (150) such as silicone and a tape (160). A gap should be left for thermal expansion of mullions (70) in vertical direction and an expansion profile (spigot) (80) should be used.

In a preferred embodiment of the invention, spacer washers (10) fixed to the concrete or stud system of a structure, wherein the horizontal tracks (20) are mounted to the wall by fixed to the spacer washers (10). For this embodiment, the spacer washer (10) should have the same thickness as the insulation layer (140). The insulation layer (140) will be cut rounded for the spacer washer (109. The spacer washer (10) should be placed in the insulation layer (140). After placing the spacing washer (10), two horizontal tracks (20) will be mounted on the wall (concrete, timber, steel, etc.) with spacer washer on each floor. The holes at both ends of the horizontal tracks (20) are round, the rest of holes are horizontal slot for expansions. While mounting only the first round hole at the starting point (wall end or corner) to fix the horizontal track (20), the other round hole is left empty to allow expansion.

In a preferred embodiment, a gap (preferably 3.8") should be left at the connection of the two horizontal tracks (20) to allow for expansion. Later, horizontal connection profiles (30) should be mounted on top and at the bottom. In order to allow expansion, horizontal track's one end will be sliding part, so only the fixed end of one horizontal track (20) will be mounted with the horizontal connection profiles (30).

In a preferred embodiment, a main horizontal track (20) is used at the level of the floor slab, which carries the dead load and wind loads, while a horizontal track (20) is used between two floor slabs against only the wind load.

Figure 2:
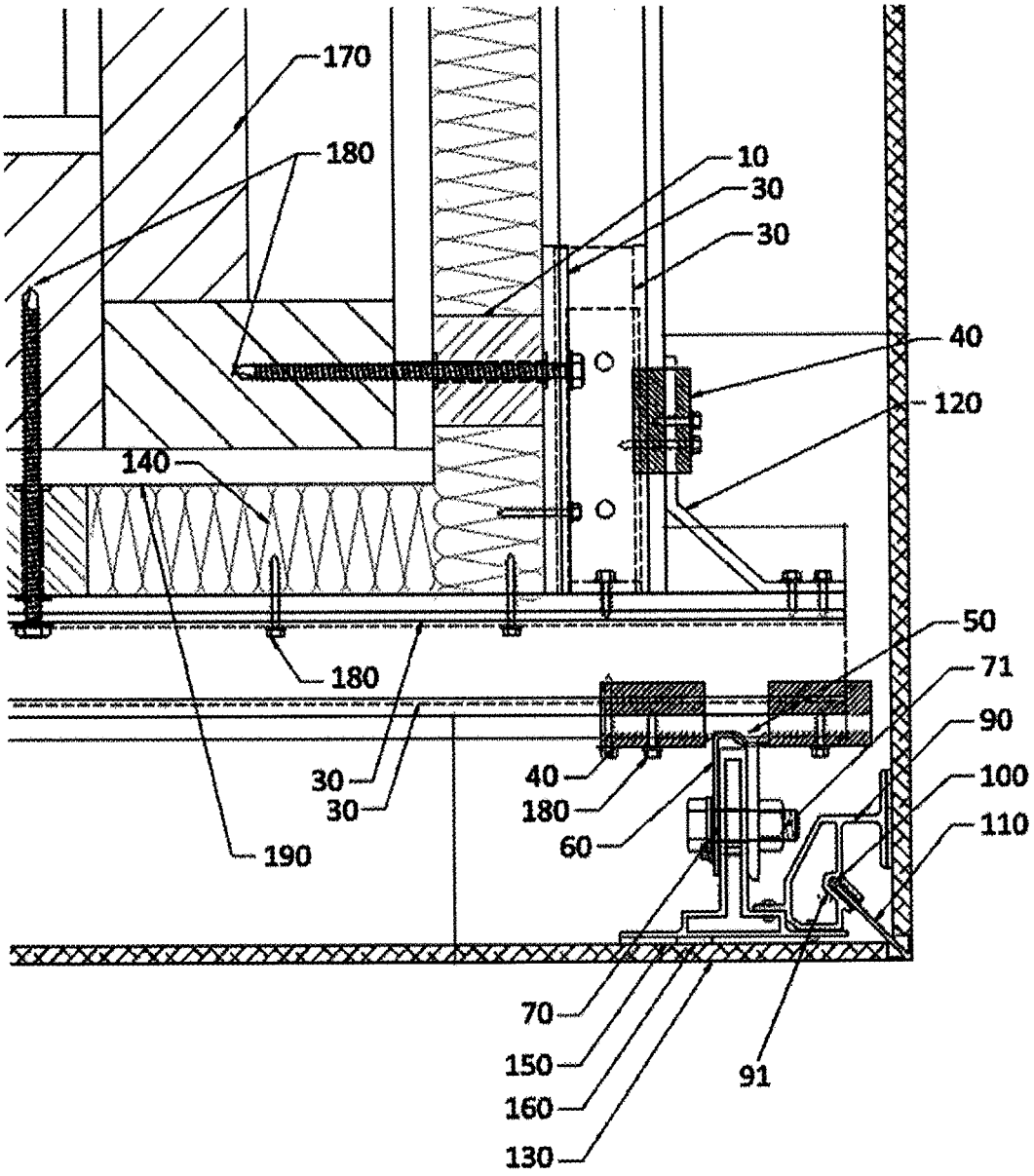
FIG. 2 shows fixed non-expanding type corner plan detail of the present invention.
Figure 3:
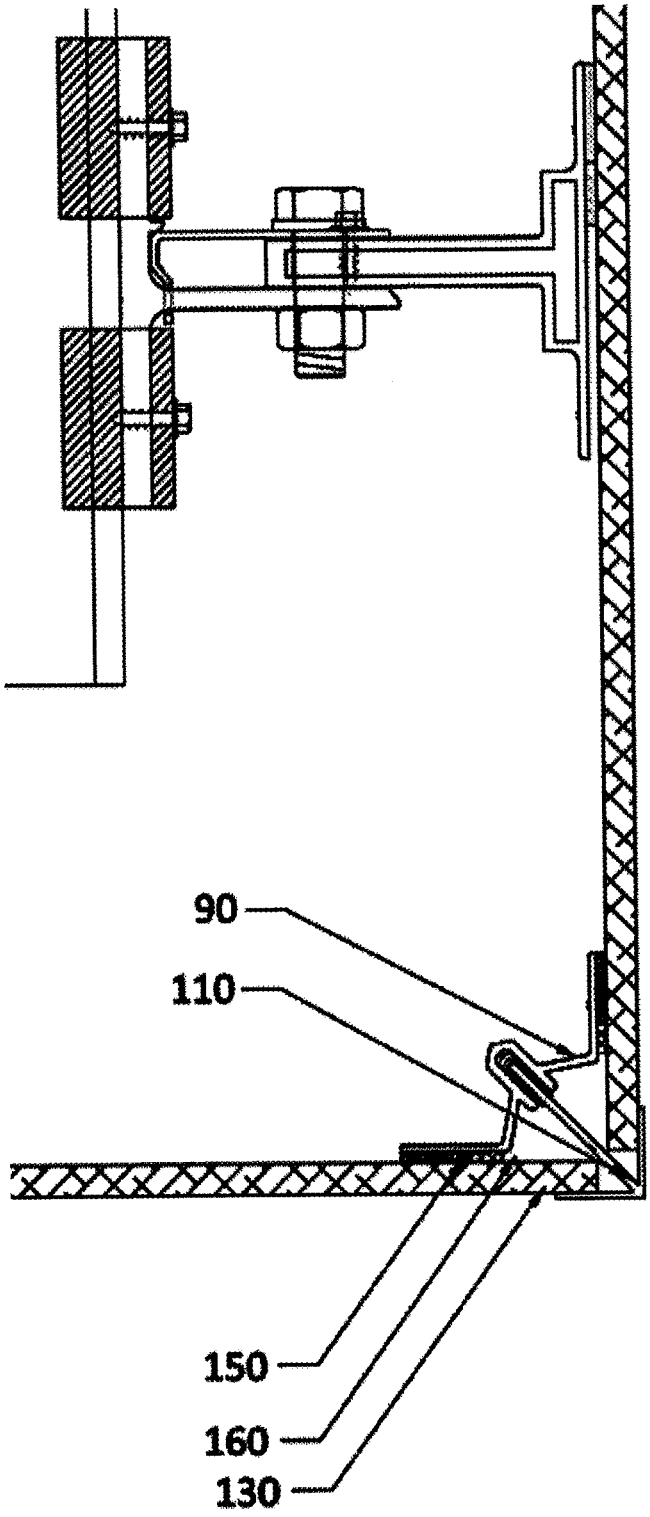
FIG. 3 shows expanding type corner plan detail of the present invention.

In a preferred embodiment, a corner profile (90) with two vertically positioned surfaces wherein the tiles (130) corresponding to corner of cladding are positioned on as shown in FIG. 2 and FIG. 3. The corner profile (90) can be fastened to a mullion profile (70) from at least one side. A corner support profile (110) can be used wherein one end supporting tiles (130) on the corner of cladding and other end is positioned in a cavity (91) formed on the corner profile (90). Corner support profile (110) ensures a smooth connection between two corner tiles (130). Additionally, a corner fixing gasket (100) can be placed in the cavity (91).

In a preferred embodiment, a corner support bracket (120) connects two vertically positioned horizontal tracks (20). Corner support brackets (120) can be mounted back side of both tracks (20) or one back and one front side of the tracks (20) so it can support the track (20) that is mounted from back side.

The invention claimed is:

1. A ventilated facade cladding system comprising:

a plurality of horizontal tracks each having a T-shaped profile or an L-shaped profile, said plurality of horizontal tracks adapted to be mounted to a wall sequentially;

a plurality of hanging clips respectively positioned on said plurality of horizontal tracks so as to be slidable on at least one of said plurality of horizontal tracks;

a plurality of brackets each having a T-shaped form or an L-shaped form, said plurality of brackets positioned between said plurality of hanging clips, said plurality of brackets being respectively fixed in a space between a respective one of the T-shaped profile or L-shaped profile of said plurality of horizontal tracks and at least one of said plurality of hanging clips;

a plurality of bracket clips having an L-shape, said plurality of bracket clips being respectively attached to said plurality of brackets that slide through a clip gap; and a plurality of T-shaped mullion profiles mounted vertically and positioned at a desired depth and fixed between respective brackets of said plurality of brackets and said plurality of bracket clips, each of said plurality of T-shaped mullion profiles having a tile bonded on a horizontal portion thereof.

2. The ventilated facade cladding system of claim 1, further comprising:

a plurality of spacer washers adapted to be fixed to a concrete system or a stud system of a structure, wherein said plurality of horizontal tracks are adapted to be mounted to the wall through fixed plurality of spacer washers.

3. The ventilated facade cladding system of claim 1, further comprising:

a corner profile having a pair of vertically positioned surfaces on which one of the tiles corresponding to a corner of a cladding is positioned.

4. The ventilated facade cladding system of claim 3, wherein said corner profile is fastened to one side of said plurality of T-shaped mullion profiles, the tile being bonded to another side of said plurality of T-shaped mullion profiles.

5. The ventilated facade cladding system of claim 3, further comprising:

a corner support profile having one end supporting tiles on the corner of the cladding, another end of said corner support profile being positioned in a cavity on said corner profile.

6. The ventilated facade cladding system of claim 5, further comprising:

a corner fixing gasket positioned in the cavity.

7. The ventilated facade cladding system of claim 1, further comprising:

a corner support bracket connecting a pair of said plurality of horizontal tracks.

8. The ventilated facade cladding system of claim 1, further comprising:

a horizontal connection profile having one end connected to one end of said plurality of horizontal tracks, another end of said horizontal connection profile slidable over a horizontal track adjacent to the one of said plurality of horizontal tracks.

9. The ventilated facade cladding system of claim 1, further comprising:

an expansion profile positioned between a pair of said plurality of T-shaped mullion profiles so as to provide a gap for thermal expansion in a vertical direction.

10. The ventilated facade cladding system of claim 1, wherein said plurality of T-shaped mullion profiles are fixed to each of said plurality of brackets and each of said plurality of bracket clips with a bolt.

* * * * *